US006695468B1

(12) United States Patent
Gschwind

(10) Patent No.: US 6,695,468 B1
(45) Date of Patent: Feb. 24, 2004

(54) WATCHES AND METHOD FOR THEIR PRODUCTION

(75) Inventor: Peter Gschwind, Mur (CH)

(73) Assignee: Time-House Handels GmbH, Hamburg (DE)

( * ) Notice: Subject to any disclaimer, the term of this patent is extended or adjusted under 35 U.S.C. 154(b) by 0 days.

(21) Appl. No.: 09/445,671

(22) PCT Filed: Jun. 3, 1998

(86) PCT No.: PCT/CH98/00240

§ 371 (c)(1),
(2), (4) Date: Jan. 25, 2000

(87) PCT Pub. No.: WO98/58299

PCT Pub. Date: Dec. 23, 1998

(30) Foreign Application Priority Data

Jun. 16, 1997 (CH) ..... 1462/97

(51) Int. Cl.[7] ..... G04B 37/18; G04B 37/22

(52) U.S. Cl. ..... 368/276; 368/280; 368/296; 368/316; 29/896.33; 29/417; 29/896.3

(58) Field of Search ..... 368/88, 281, 282, 368/278, 298, 327, 301; 29/896.3, 896.33, 413, 417; D10/32

(56) References Cited

U.S. PATENT DOCUMENTS

| | | | | | |
|---|---|---|---|---|---|
| 2,022,263 | A | * | 11/1935 | Whitehead | 29/896.3 |
| 2,801,779 | A | * | 8/1957 | Jenkins | 224/164 |
| 3,293,846 | A | * | 12/1966 | Pauli | 368/276 |
| 4,379,643 | A | * | 4/1983 | Halicho | 368/309 |
| 4,444,513 | A | * | 4/1984 | Proellochs et al. | 368/276 |
| 4,490,052 | A | * | 12/1984 | Gogniat | 368/292 |
| 4,740,935 | A | * | 4/1988 | Gogniat | 368/294 |
| D322,227 | S | * | 12/1991 | Warhol | D10/32 |
| 5,077,710 | A | * | 12/1991 | Gogniat | 368/281 |
| 6,322,245 | B1 | * | 11/2001 | Cooper | 368/276 |

FOREIGN PATENT DOCUMENTS

| | | | | |
|---|---|---|---|---|
| CH | 682 290 | A | 8/1993 | |
| DE | 85 30 739 | U | 4/1986 | |
| DE | 87 06 553 | U | 6/1987 | |
| DE | 94 17 048 | U | 12/1994 | |
| FR | 2 618 919 | A | 2/1989 | |
| FR | 2618919 | A1 * | 2/1989 | 368/276 |
| FR | 2725821 | A * | 10/1994 | |

OTHER PUBLICATIONS

Journal Suisse D'Horlogerie et de Bijouterie, Nr. 3, 1988, XP002075589, p. 503.

* cited by examiner

*Primary Examiner*—David Martin
*Assistant Examiner*—Jeanne-Marguerite Goodwin
(74) *Attorney, Agent, or Firm*—Oppedahl & Larson LLP

(57) ABSTRACT

Several watches (1.1–1.4) are placed in an arrangement and interconnected by connecting means (2.1–2.3). The watches (1.1–1.4) have cover glasses (11.1–11.4), dials (12.1–12.4), cases (13.1–13.4), winders (14.1–14.4) and time indicating means (15.1–15.4). The connecting means (2.1–2.3) are e.g. located on a carrier element (20) containing the dials (12.1–12.4) of all the watches (1.1–1.4). The carrier element (20) has preset breaking lines (3.1–3.3) in the form of perforations and cross-sectional reductions between the watches (1.1–1.4), so that said watches (1.1–1.4) can be separated from one another. The arrangement or watches (1.1–1.4) separated therefrom can be used as fashion accessories jewellery, pendants, etc. There are no practical limits to the design of the arrangement and its watches (1.1–1.4). The arrangement can be manufactured in a simple, advantageous manner, so that it is in particular possible to take account of rapidly changing fashions.

20 Claims, 7 Drawing Sheets

Figure 1:
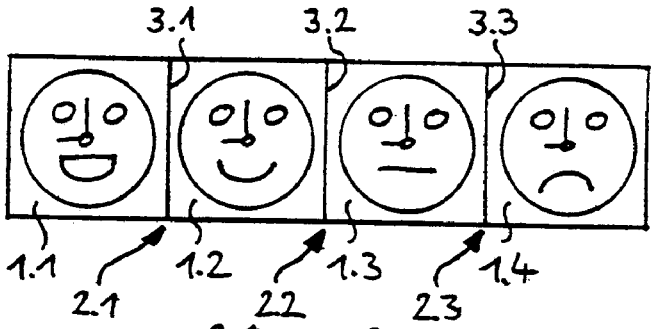

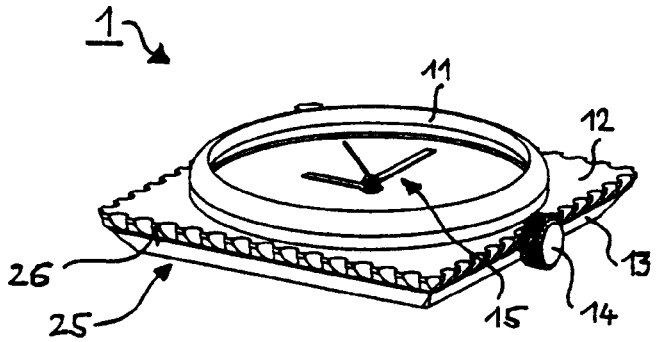
Fig. 17
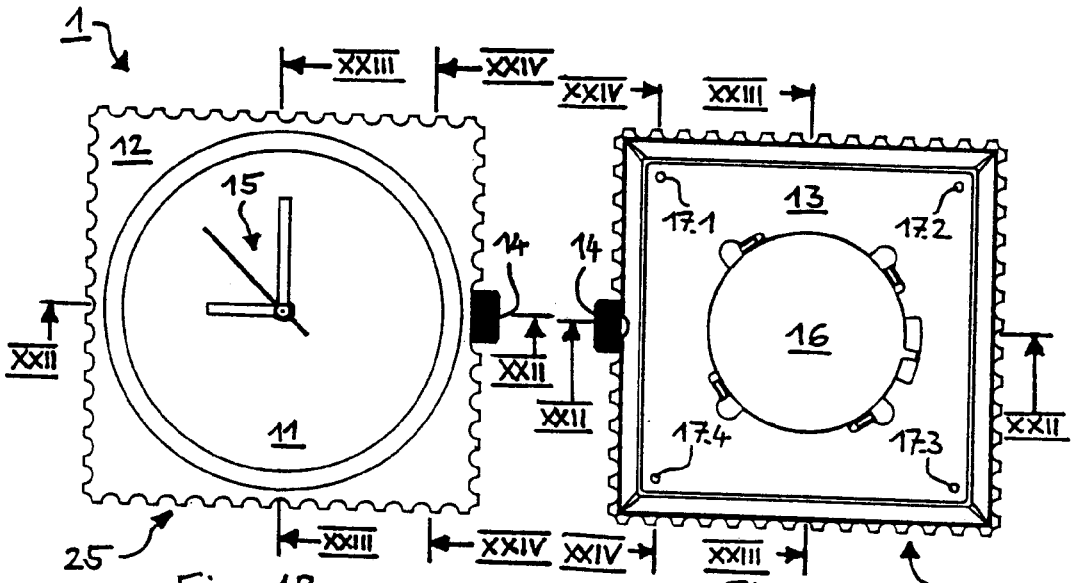
Fig. 18
Fig. 19
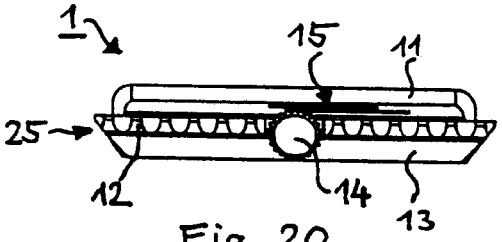
Fig. 20
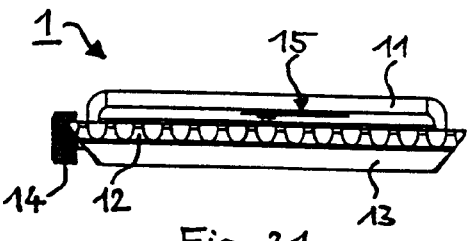
Fig. 21

WATCHES AND METHOD FOR THEIR PRODUCTION

The invention relates to an arrangement of at least two watches, to a watch separated from this arrangement and to a method for the manufacture of this arrangement, according to the preambles of the independent claims.

Over the past 30 years the manufacturing methods, appearance, intended use and social value of personally worn watches have changed. In earlier times the manufacture of watches constituted labour-intensive precision work, which had to be carried out by highly qualified personnel. Watches were mainly made from valuable, durable materials such as metal and glass. Thus, a watch, usually a mechanical wrist or pocket watch, was an expensive purchase, which was made only once or at the most a few times during a lifetime. The situation is now different. Plastics technology and microelectronics permit the inexpensive mass production of watches by less qualified personnel. The price for such watches is low. Watches are bought, collected and worn as fashion accessories. Therefore there is a great demand for watches having an original, ever-changing design.

Such watches constitute the subject matter of the present invention and, like a manufacturing method for such watches, will be defined in the independent claims.

The invention is based on the idea of creating, manufacturing and marketing an arrangement of at least two watches interconnected by connecting means. Watches within the arrangement are preferably separable from one another. This creates the possibility of separating the watches again at a later time which can be freely chosen by the owner and the use thereof in a random manner.

The connecting means can e.g. be formed by a single carrier element and/or by watch components such as the dial, cover glass and/or case or can be located on a carrier element. The carrier element can incorporate the dials, cover glasses or cases of all the watches. In a preferred embodiment the carrier element contains the dials of all the watches, the cover glasses being connected to a first surface of the carrier element and the case to a second surface of the carrier element. The dials, cover glasses and/or case are preferably made from plastic. The connecting means between at least two watches can be formed by additional elements and not by watch components. Such connecting means can e.g. be subsequently removed from the watches, so that the watches can be separated from one another.

The possibility of separating the watches from one another is preferably implemented by a preset breaking line between two watches within the arrangement. A preset breaking line can e.g. be implemented as a constriction or cross-sectional reduction and/or as a perforation in the connecting means. In this case the watches are separated from one another by being broken apart along the preset breaking point.

The arrangement of watches according to the invention can be one-dimensional in the sense that in each case one watch is connected to a maximum of two other watches. One-dimensional arrangements can e.g. be straight, which leads to a "watch (chocolate) bar", from which the individual watches can be broken off. One-dimensional arrangements can also have a random curvature. It is also possible to have closed, one-dimensional (in the sense of the above definition) forms, e.g. a ring of separable watches.

The arrangement can also be two-dimensional in the sense that there is at least one watch in the arrangement, which is connected to more than two watches. Two-dimensional arrangements can be surface-covering and can e.g. comprise square or rectangular watches, which leads to a "watch (chocolate) block" or a "watch (postage stamp) sheet". However, non-surface-covering, two-dimensional arrangements are also possible, e.g. a "watch lattice" with vacancies.

To at least one watch of the inventive arrangement can be fitted fastening means. They make it possible to fasten the at least one watch and/or the arrangement, as a function of the intended use, to an article and/or to a surface, e.g. to a part of the body, an article of clothing, a bag, a piece of furniture, a vehicle, a plant, etc. Such fastening means are able to produce integral, friction or positive connections with the object and/or surface. Examples of such fastening means are bracelets, spring catches, plug-in fastenings, threading and hanging on means, adherable or adhesive surfaces, magnets, etc.

In the method for the manufacture of an arrangement according to the invention the carrier element containing the dials of all the watches, the cover glasses and the case are manufactured and the cover glasses and case are connected to the carrier element. The carrier element, cover glasses and case are preferably manufactured by injection moulding from plastic. The cover glasses and case are then preferably bonded and/or welded to the carrier element.

An advantageous method for the manufacture of a carrier element incorporating the dials of all the watches is known as "in-mould labelling". In this a plastic film is printed with the patterns intended for the arrangement, placed in an injection mould and sprayed with plastic. An advantage of this method compared with the direct printing of the watch components is that for printing purposes it is possible to choose a particularly suitable film, i.e. which has good characteristics with respect to colour reproduction and fastness.

It is naturally left to the owner to decide whether or not to separate the watches. It is also conceivable to use the arrangement as such or as parts comprising several watches. This can e.g. be desirable due to the unusual, noteworthy appearance of several interconnected watches, or to set or read off different times on the different watches of the arrangement.

The invention makes available a hitherto unimagined range of use possibilities. The arrangement according to the invention, parts thereof or individual watches separated from the arrangement can be used as fashion accessories, jewellery, pendants, advertising gifts, notification, greeting, congratulatory, visiting cards, etc. There are no limits to the design of the inventive arrangement and its watches. The watches of an inventive arrangement can have the same or different forms or appearances. In addition, the arrangement according to the invention can be easily and advantageously manufactured, which makes it possible for less wealthy consumers to obtain such arrangements or watches and therefore take account of the rapidly changing fashion taste.

The invention is described in greater detail hereinafter relative to the attached drawings, wherein show:

FIGS. 1 to 5 Diagrammatic plan views of different arrangements of watches according to the invention.

FIGS. 6 to 12 Diagrammatic side views of different arrangements according to the invention.

FIGS. 13 to 16 Different views of a preferred embodiment of the arrangement according to the invention.

FIGS. 17 to 21 Different views of an inventive watch separated from the preferred arrangement.

Figure 22:
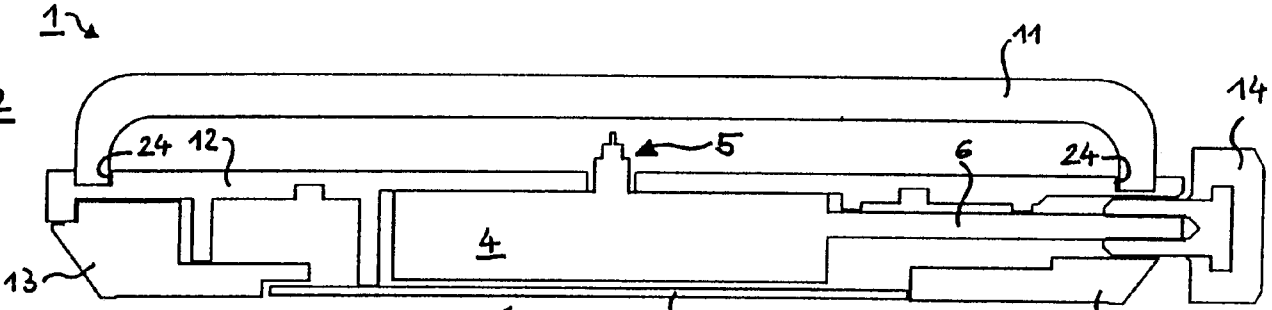
Figure 23:
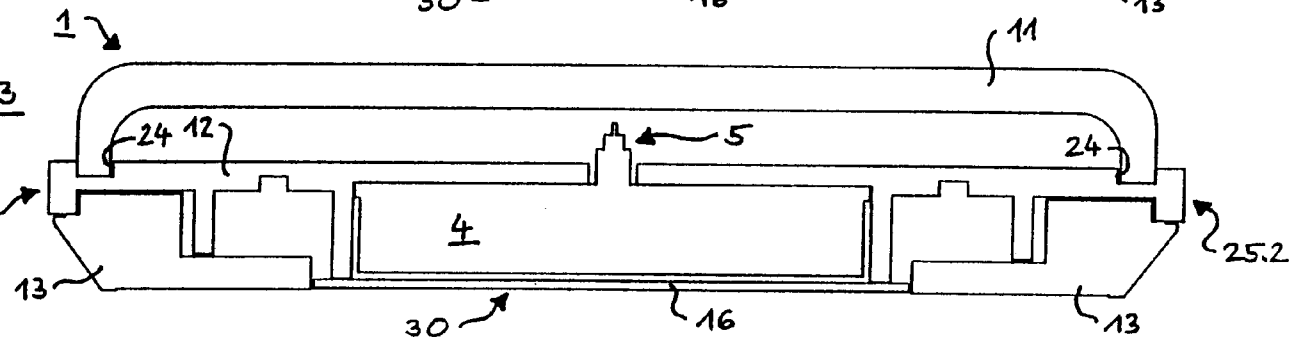
Figure 24:
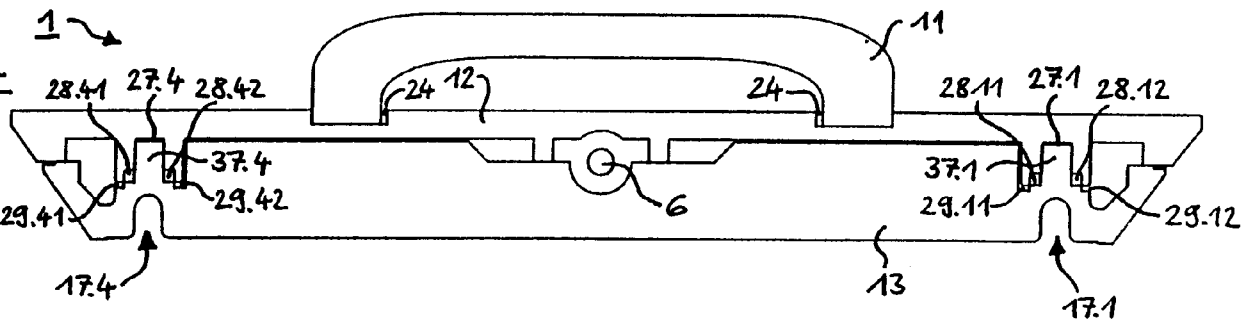

FIGS. 22 to 24 Different cross-sections through a watch according to the invention.

FIGS. 1 to 5 diagrammatically show plan views of different arrangements of watches according to the invention and deals more particularly with possible configurations of arrangements. Connecting means, which connect the watches, are only intimated in FIGS. 1 to 5 and further details with respect thereto will be provided by FIGS. 6 to 15.

FIG. 1 shows a preferred embodiment of the arrangement according to the invention. Four watches 1.1–1.4 are interconnected in a straight, one dimensional arrangement by connecting means 2.1–2.3, which leads to an arrangement similar to a chocolate bar. The arrangement is one-dimensional in the sense that in each case one watch is connected to a maximum of two other watches. The watches 1.1–1.4 are preferably separable from one another, e.g. at preset breaking lines 3.1–3.3, which are located on the connecting means 2.1–2.3 between in each case two watches 1.1–1.4. As in FIG. 1, the watches 1.1–1.4 within the arrangement can have different appearances giving a user the possibility to choose and wear an appropriate watch 1.1–1.4 as a function of the day, mood, weather, occasion, clothing, etc. Obviously not only the patterns but also the shapes and configurations of the watches can differ. As in the following drawings, the watches within the arrangement can also have the same appearances.

Figure 2:
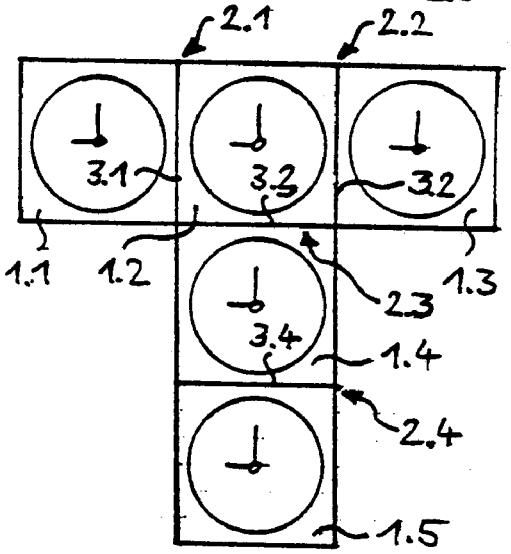
Figure 3:
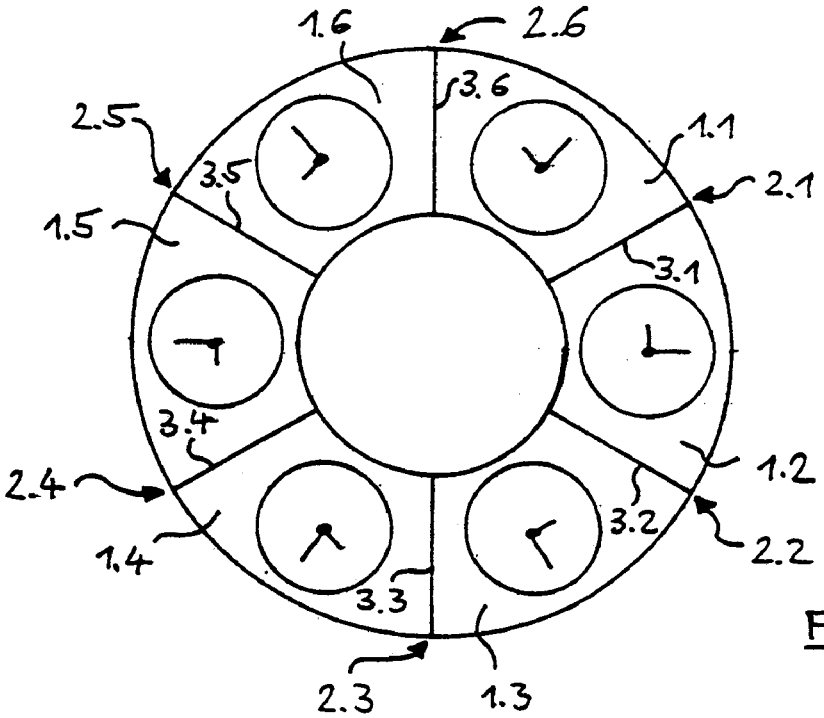
Figure 4:
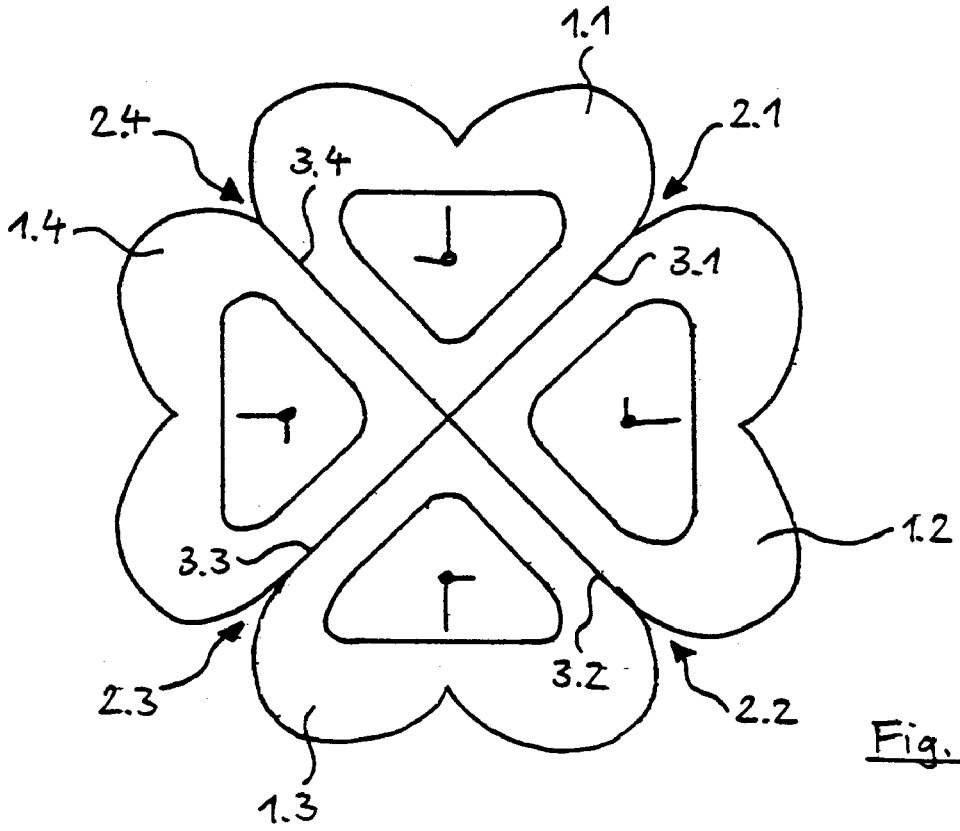
Figure 5:
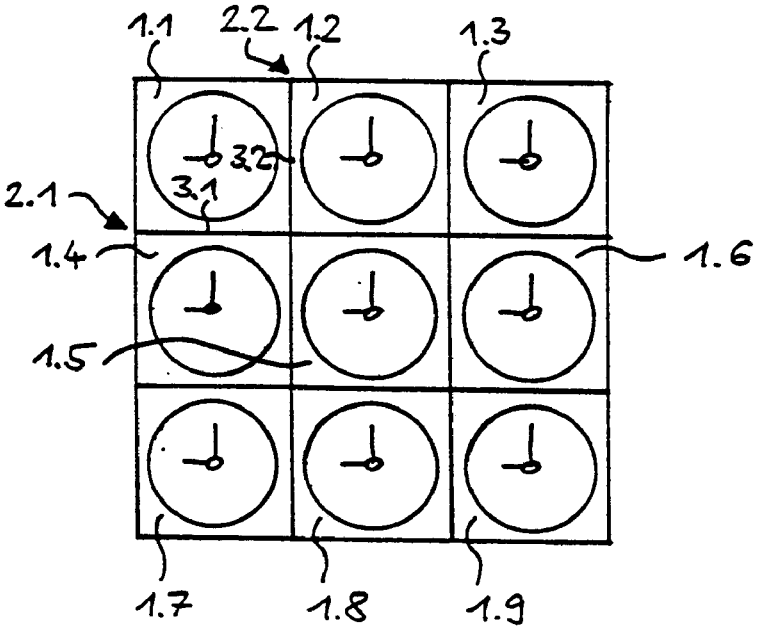

FIG. 2 shows a two-dimensional, e.g. T-shaped arrangement of five watches 1.1–1.5. This arrangement is two-dimensional in the sense that there is at least one watch 1.2 in the arrangement, which is connected to more than two watches 1.1, 1.3, 1.4. The one-dimensional arrangement of six watches 1.1–1.6 in FIG. 3 is O-shaped, whilst that of four watches 1.1–1.4 in FIG. 4 is clover leaf-shaped The two-dimensional arrangement of nine watches 1.1–1.9 in FIG. 5 is like a chocolate bar or sheet of postage stamps. In order not to overburden FIG. 5 with reference numerals, only two connecting means 2.1, 2.2 and two preset breaking lines 3.1, 3.2 are shown.

FIGS. 6 to 12 show diagrammatic side views of different one-dimensional arrangements according to the invention with in each case four watches 1.1–1.4 and mainly deals with the connecting means between the watches 1.1–1.4. The main components of the watches 1.1–1.4 are the cover glass 11.1–11.4, dial 12.1–12.4 and case 13.1–13.4.

Figure 6:
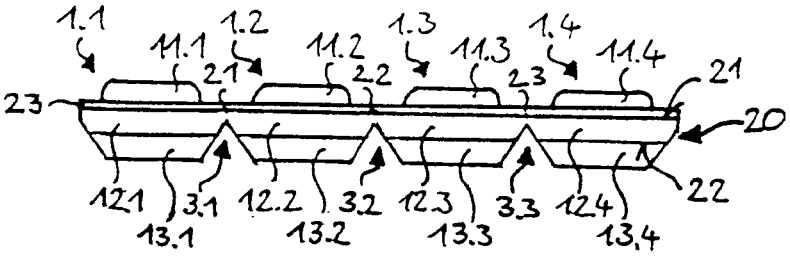

FIG. 6 shows an inventive arrangement of watches 1.1–1.4. In this preferred embodiment the connecting means 2.1–2.3 between the watches 1.1–1.4 is formed on or by a single carrier element 20. The carrier element 20 incorporates the dials 12.1–12.4 of all the watches 1.1–1.4. It can therefore be said that the connecting means 2.1–2.3 between the watches 1.1–1.4 are formed by the dials 12.1–12.4. The carrier element 20 is preferably a relatively rigid plastic plate. Between the watches 1.1–1.4 there are preset breaking lines 3.1–3.3 in the carrier element 20 and are implemented in the latter e.g. as constrictions or cross-sectional reductions. The cover glasses 11.1–11.4 are connected to a first surface 21 of the carrier element 20 and the cases 13.1–13.4 are connected to a second surface 22 of the carrier element 20. These connections are preferably integral. The cover glasses 11.1–11.4 and cases 13.1–13.4 are e.g. bonded and/or welded to the carrier element 20. The carrier element 20, cover glasses 11.1–11.4 and cases 13.1–13.4 are preferably made from plastic. The term "cover glass" used in this specification comes from the terminology of conventional watches and is not in contradiction thereto, i.e. provides no information on the actual material.

The embodiment of FIG. 6 is preferably manufactured in that firstly the carrier element 20 Incorporating the dials 12.1–12.4, the cover glasses 11.1–11.4 and the cases 13.1–13.4 are manufactured, e.g. from plastic by injection moulding. Then the cover glasses 11.1–11.4 and the cases 13.1–13.4 are joined to the carrier element 20, e.g. by bonding and/or welding, in which case ultrasonic welding can be used.

The carrier element 20 is advantageously produced by the known in-mould labelling. In this a plastic film 23 printed with the pattern intended for the arrangement is placed in a not shown injection mould and sprayed with plastic. The plastic film is then located on the first surface 21 of the carrier element 20. For printing purposes it is possible to choose a particularly suitable film 23, i.e. having good characteristics with regards to colour reproduction and fastness. This method can be more advantageous than directly printing the carrier element 20.

Figure 7:
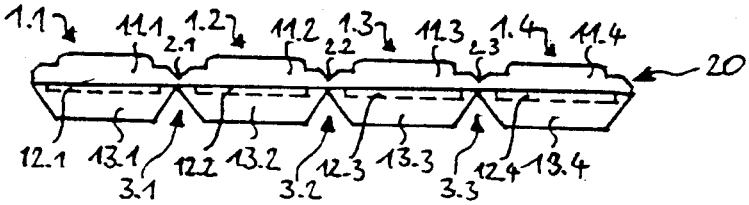

In the arrangement of FIG. 7 the connecting means 2.1–2.3 between the watches 1.1–1.4 are formed by the cover glasses 11.1–11.4 thereof. The cover glasses 11.1–11.4 bounded by the preset break-in lines 3.1–3.3 can be looked upon as a carrier element 20 for the arrangement. The dials 12.1–12.4, intimated in broken line form, can e.g. be fixed or secured between the cover glasses 11.1–11.4 and cases 13.1–13.4.

Figure 8:
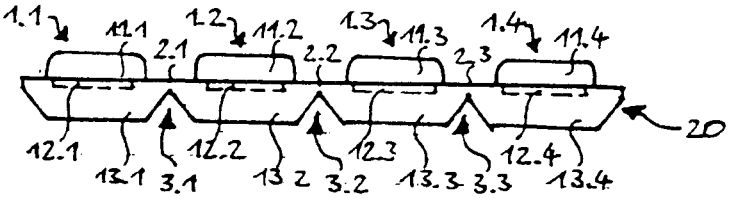

In the arrangement of FIG. 8 the connecting means 2.1–2.3 are formed between the watches 1.1–1.4 by the cases 13.1–13.4 thereof. The cases 13.1–13.4 defined with respect to one another by preset breaking lines 3.1–3.3 can also form a carrier element 20.

Figure 9:
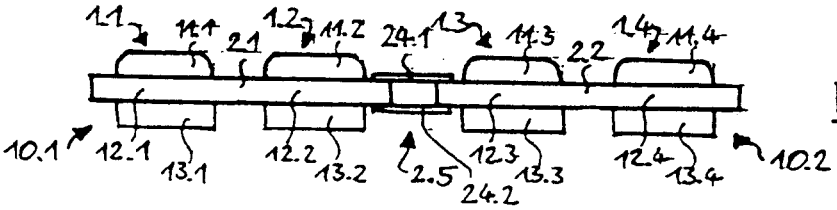

FIG. 9 shows an arrangement of four watches 1.1–1.4, whereof in each case two watches 1.1, 1.2 or 1.3, 1.4 are interconnected by means of their dials 12.1, 12.2 or 12.3, 12.4, which form first connecting means 2.1 or 2.2 and in this way form two partial arrangements 10.1, 10.2. In this embodiment the in each case two watches 1.1, 1.2 of a partial arrangement 10.1 interconnected by their dials 12.1, 12.2 cannot be separated from one another, because there is no preset breaking point between them. However, the two partial arrangements 10.1, 10.2 or the two central watches 1.2, 1.3 of the arrangement can be separated from one another. A first connecting means 2.5 connecting the two central watches 1.2, 1.3 e.g. comprises two bendable strips 24.1, 24.2, which are bonded to the dials 12.2, 12.3. The second connecting means 2.5 can be subsequently removed from the watches 1.2, 1.3.

Figure 10:
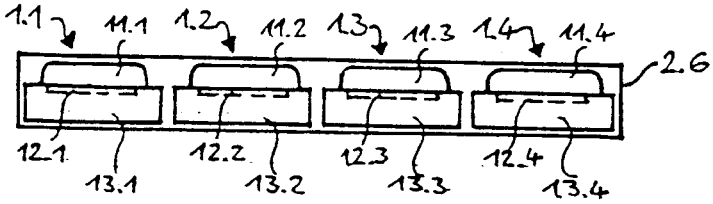

FIG. 10 shows another embodiment with a subsequently removable connecting means 2.6. Four watches 1.1–1.4 are here connected by an envelope or wrapper 2.6 as the connecting means. Such an envelope 2.6 can e.g. form the packing of watches 1.1–1.4 and can be made from transparent plastic film, paper, etc.

Figure 11:
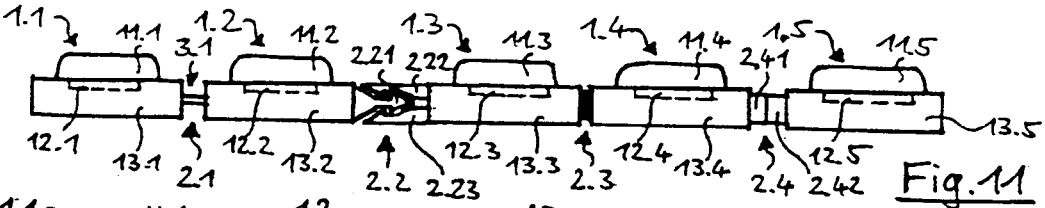

FIG. 11 shows an arrangement with further different connecting means 2.1–2.4 between watches 1.1–1.5. A first connecting means 2.1 can e.g. be constructed as a thin bar or thin plate and can be shaped from or fitted to the two watches 1.1, 1.2 to be connected. Due to its small cross-section, the first connecting means 2.1 simultaneously forms a preset breaking point 3.1. A second connecting means 2.2 is constructed as a positively engaging, reversible connection, e.g. as a diagrammatically represented spring catch with an insert part 2.21, which is retained by two flexible portions 2.22, 2.23. A third connecting means 2.3 is constructed as a materially integral connection, e.g. as a reversible or non-reversible bond. A fourth connecting means 2.4 is constructed as a frictional connection, e.g. as a magnetic connection with two permanent magnets 2.41, 2.42.

Figure 12:
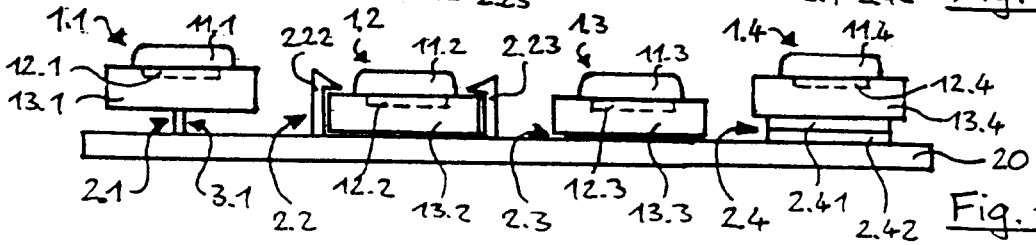

FIG. 12 shows further variants of connecting means 2.1–2.4 for an inventive arrangement. The arrangement has a single carrier element 20, which is subsequently removable from the watches 1.1–1.4. The four watches 1.1–1.4 of the arrangement are connected in different ways to the carrier element 20. As in FIG. 11 the connections 2.1–2.4 between the watches 1.1–1.4 and the carrier element 20 can be constructed as a preset breaking line 3.1, with positive engagement (e.g. with two flexible portions 2.22, 2.23) integrally (e.g. with adhesive 2.3) or in frictionally engaging manner (e.g. with two magnets 2.41, 2.42).

The watch 1.4 to the far right in FIG. 12 is provided with a magnet 2.41 which, following the separation of the watch 1.4 from the arrangement, can be used as a fastening means. Such a fastening means makes it possible, as a function of the intended use, to fasten the watch to an object and/or a surface, e.g. in the case of a magnet 2.41 to a refrigerator door, a piece of furniture, a vehicle, etc. The magnet 2.41 constitutes a frictional fastening means. Other fastening means can provide positively engaging or integral connections to the object and/or surface.

Obviously the connecting means 2.1–2.6 diagrammatically represented in FIGS. 6 to 12 only have an exemplified character. With the knowledge of the invention it is possible for the expert to differently design the connecting means and/or combine them with one another and in this way create other, not shown arrangements, but which still belong to the present invention.

Figure 13:
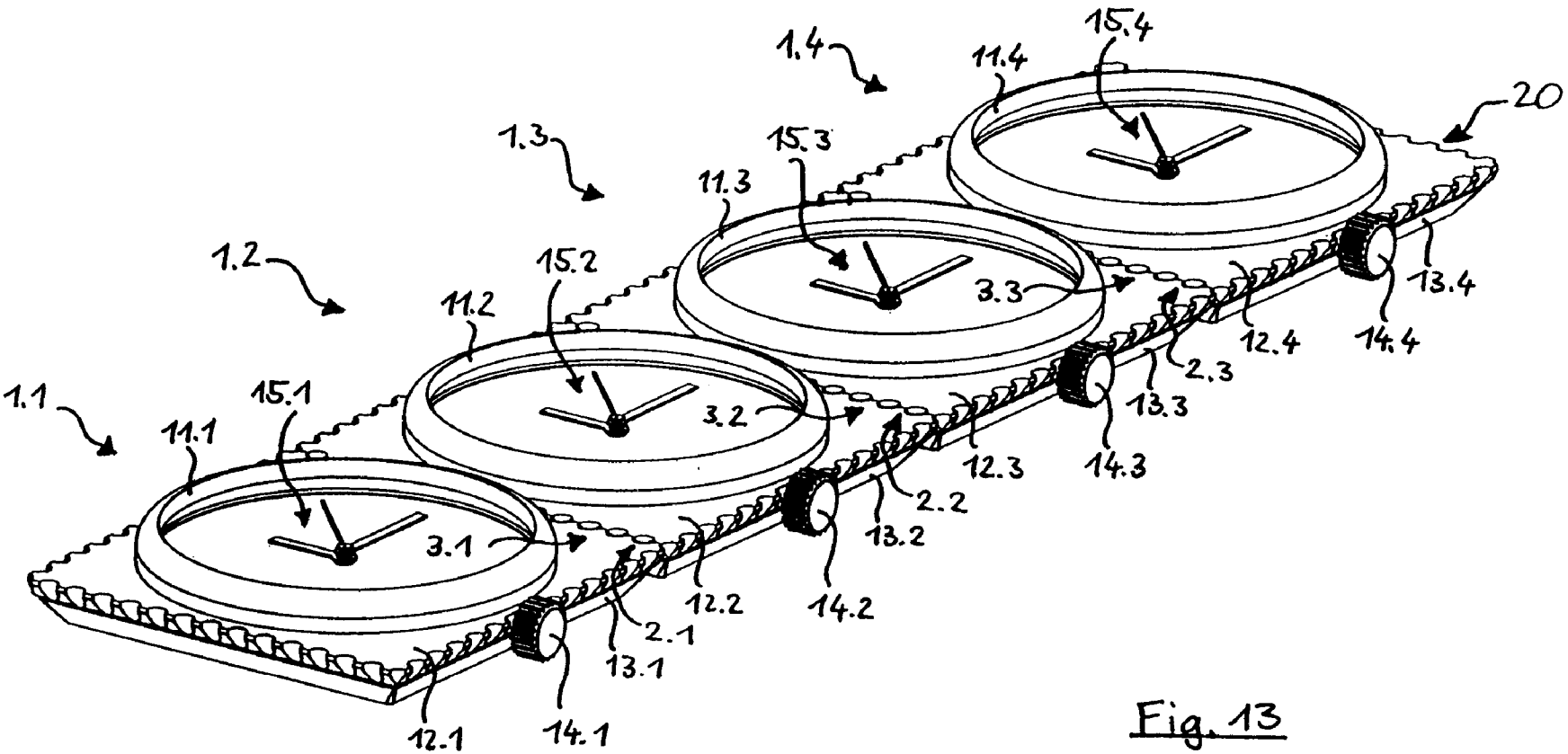
Figures 14, 15, 16:
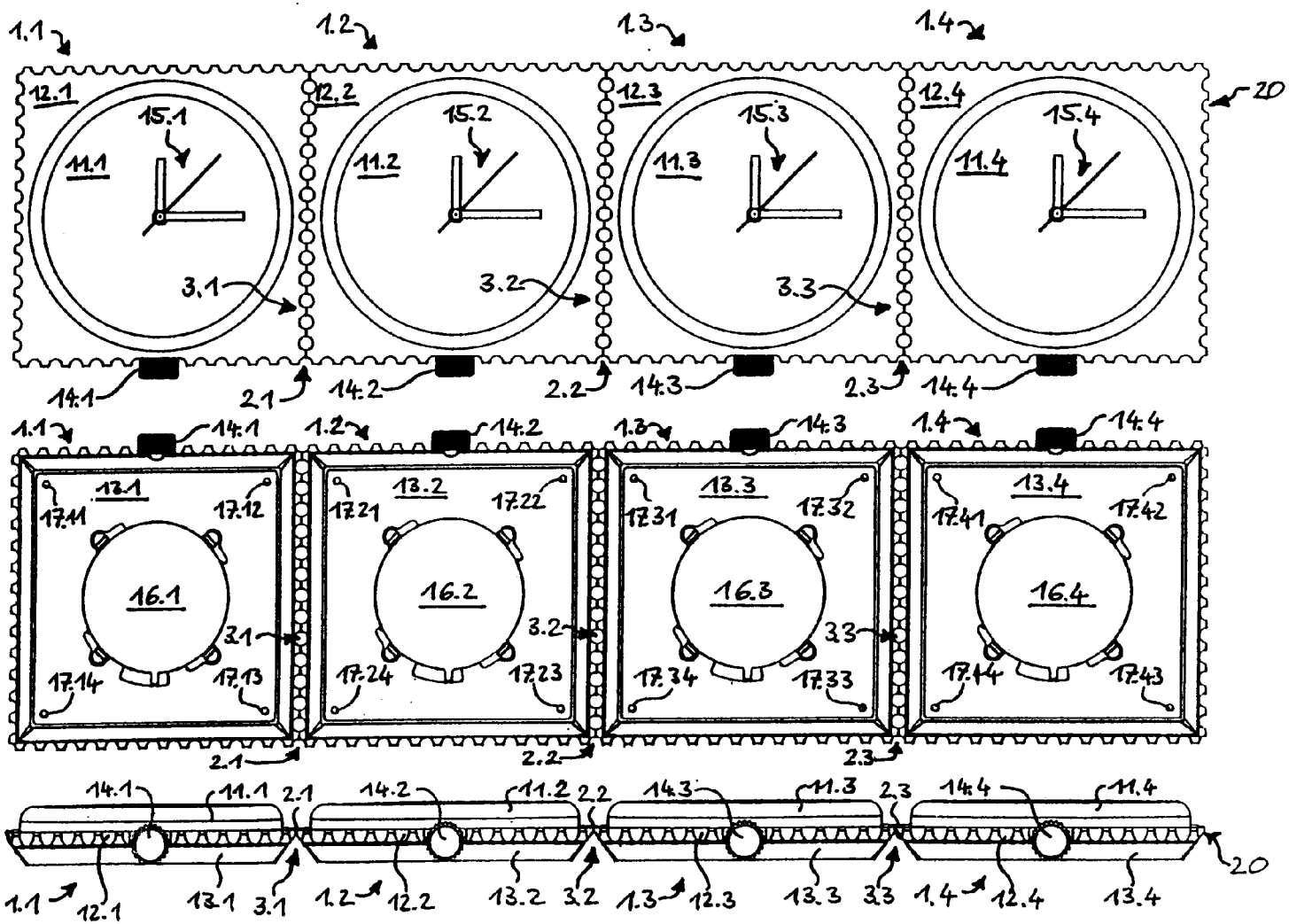

FIGS. 13 to 16 provide different views of a preferred embodiment of the arrangement according to the invention. The arrangement roughly corresponds to those of FIGS. 1 and 6. It has four watches 1.1–1.4 arranged in a row and which are interconnected by means of their dials 12.1–12.4. Thus, connecting means 2.1–2.3 are formed by shapes on the dials 12.1–12.4. The dials 12.1–12.4 are contained by a single carrier element 20. The carrier element 20 has preset breaking lines 3.1–3.3 in the form of perforations and cross-sectional reductions between the watches. The individual watches 1.1–1.4 are e.g. square. On all four sides each watch 1.1–1.4 has a toothed system, so its shape is similar to that of a postage stamp. In FIGS. 12 to 16 it is possible to see cover glasses 11.1–11.4, cases 13.1–13.4, winders 14.1–14.4 and time indicating means 15.1–15.4, e.g. hands of the watches 1.1–1.4. FIG. 15 also shows a case cover 16.1–16.4, below which are located not shown movements and batteries and welding lugs 17.11–17.14, 17.21–17.24, 17.31–17.34, 17.41–17.44 resulting from the manufacturing procedure (cf. FIG. 24).

FIG. 13 is a perspective view of the arrangement, FIG. 14 a plan view from above, FIG. 15 a plan view from below and FIG. 16 a side view from the side of the winders 14.1–14.4, i.e. from the 3 o'clock direction.

FIGS. 17 to 21 show a single inventive watch 1, which is separated from the arrangement shown in FIGS. 13 to 16. This inventive watch 1 can inter alia be distinguished from prior art watches in that it has connecting means for connection to further watches and/or traces of previously existing connecting means. The watch shown here (as in FIGS. 6 to 12) was originally connected on at least one side 25, by means of the dial 12 to another watch. Following the separation of the watch 1 along a preset breaking point the breaking surface 26 on the first side 25 is clearly identifiable as a breaking point as a result of its structure, so that the inventive watch 1 differs from a similar watch manufactured as an individual watch. Other traces of previously existing connecting means are e.g. not shown adhesive residues.

FIG. 17 is a perspective view of the watch, FIG. 18 a plan view from above, FIG. 19 a plan view from below, FIG. 20 a side view from the winder side, i.e. from the 3 o'clock direction and FIG. 21 a side view from the 12 o'clock direction. FIG. 21 could equally well be a side view of the entire arrangement shown in FIGS. 13 to 16. FIG. 19 also shows a case cover 16 and welding lugs 17.1–17.4 (cf. FIG. 24).

To the watches of the inventive arrangement can be fitted not shown fastening means for fastening the watches to articles and/or surfaces. Examples of fastening means are bracelets, spring catches, plug-in fastenings, threading and hanging on means, adherable or adhesive surfaces, magnets, etc. Such fastening means are known per se and it is easy for an expert to fit them at appropriate points of watches according to the invention.

FIGS. 22 to 24 show different cross-sections through an inventive watch 1 shown in FIGS. 17 to 21. The sectional planes are indicated in FIGS. 18 and 19. In FIGS. 22 to 24 it is possible to see the three main components, namely the cover glass 11, dial 12 and case 13. The cover glass 11 and case 13 are preferably integrally connected to the dial 12, e.g. by bonding and/or welding thereto. Depressions or grooves 24 are made in the dial 12 for receiving and precisely positioning the cover glass 11 and/or case 13.

FIG. 22 shows a cross-section along the "9 o'clock–3 o'clock" lines. A movement 4 is diagrammatically shown between the dial 12 and case 13, hand spindles 5, a winder spindle 6 and a winder 14 mounted thereon, but the actual hands are not shown for reasons of simplicity. The case has an opening 30 through which can be inserted or removed the movement 4 and/or a not shown battery, said opening 30 being closed by a cover 16.

FIG. 23 shows a cross-section through the inventive watch 1 along the "6 o'clock–12 o'clock" lines. Connecting means to other watches or traces thereof can e.g. exist on a first side 25.1 and/or a second side 25.2, if said watch 1 is separated from an arrangement according to FIGS. 13 to 16. However, for reasons of simplicity it is not shown in FIG. 23.

The cross-sectional plane of FIG. 24 is parallel to that of FIG. 23, but along the rim of the inventive watch 1, so that it is possible to see welding lugs 17.1–17.4. Such welding lugs 17.1–17.4 can form integral connections between the dial 12 and case 13 made from plastic. For the production of such connections at corresponding points there are recesses 27.1, 27.4 or studs 37.1, 37.4. The parts 12, 13 to be connected are mutually positioned and placed on one another. A not shown ultrasonic weld is applied to at least one of the parts 12, 13, so that the latter parts are welded together. Initially overlapping material 28.11, 28.12, 28.41, 28.42 falls back into cavities 29.11, 29.12, 29.41, 29.42 provided, so that an optimized connection is obtained. It is also possible to see the winder spindle 6.

The drawings in each case show identical watches 1, 1.1–1.9 with hands 15. The invention obviously also covers watches with other time indicating means, e.g. digital watches.

What is claimed is:

1. An arrangement of at least two watches, in which the watches of the arrangement are connected by rigid connecting means and in which the rigid connecting means have preset breaking lines, so that the watches are separable from one another, the arrangement further comprising a carrier element containing the rigid connecting means, the carrier element simultaneously an essential component of each individual watch within the arrangement, so that the rigid connecting means are an essential component of the watches of the arrangement when they are separated.

2. The arrangement according to claim 1, characterized in that each watch of the arrangement has a cover glass, a dial and a case and that the carrier element contains the cover glass, dial and case of all the watches.

3. The arrangement according to claim 2, characterized in that the carrier element contains the dial of all the watches and that the cover glass are connected to a first surface of the carrier element and the case to a second surface of the carrier element.

4. The arrangement according to claim 3, characterized in that the cover glass and case are connected in materially integral manner to the carrier element.

5. A method for the manufacture of an arrangement according to claim 3, characterized in that the carrier element, cover glasses and cases are manufactured and the cover glasses and cases are connected to the carrier element, the method comprising the steps of connecting the carrier element to the cover glasses.

6. The method of claim 5, comprising the additional step, performed after the connecting step, of separating the carrier element, cover glass and case into a plurality of watches.

7. The method according to claim 6 wherein the separating step is performed by a consumer after purchase.

8. The method according to claim 5, characterized in that the carrier element, cover glass and case are manufactured from plastic by injection molding.

9. The method according to claim 5, characterized in that the carrier element is manufactured in that a plastic film is printed, placed in an injection mold and sprayed with plastic.

10. The method according to claim 5, characterized in that the cover glass and case are bonded or welded to the carrier element.

11. The arrangement according to claim 1, characterized in that the preset breaking line is in the form of a constriction or cross-sectional reduction or perforation in the connecting means.

12. The arrangement according to claim 1, characterized in that the cover glass, dial and case are made from plastic.

13. The arrangement according to claim 1, characterized in that the at least two watches have different appearances from each other.

14. An arrangement of at least two watches, in which the watches of the arrangement are connected by rigid connecting means and in which the rigid connecting means have preset breaking lines, so that the watches are separable from one another, characterized by a carrier element containing the rigid connecting means and which is simultaneously an essential component of each individual watch within the arrangement.

15. A method for use with an arrangement of at least two watches, in which the watches of the arrangement are connected by rigid connecting means and in which the rigid connecting means have preset breaking lines, so that the watches are separable from one another, the arrangement further comprising a carrier element containing the rigid connecting means, the carrier element simultaneously an essential component of each individual watch within the arrangement, so that rigid connecting means are an essential component of the watches of the arrangement when they are separated, characterized in that each watch of the arrangement has a cover glass, a dial and a case and that the carrier element contains the cover glasses, dials and/or cases of all the watches, further characterized in that the carrier element contains the dials of all the watches and that the cover glasses are connected to a first surface of the carrier element and the case to a second surface of the carrier element, further characterized in that the carrier element, cover glasses and cases are manufactured and the cover glasses and cases are connected to the carrier element, the method comprising the steps of:

connecting the carrier element to the cover glasses.

16. The method of claim 15 comprising the additional step, performed after the connecting step, of separating the carrier element, cover glasses and cases into a plurality of watches.

17. The method according to claim 16 wherein the separating step is performed by a consumer after purchase.

18. The method according to claim 15, characterized in that the carrier element, cover glasses and cases are manufactured from plastic by injection molding.

19. The method according to claim 15, characterized in that the carrier element is manufactured such that a plastic film is printed, placed in an injection mold and sprayed with plastic.

20. The method according to claim 15, characterized in that the cover glasses and cases are bonded or welded to the carrier element.

* * * * *